US005701834A

United States Patent [19]

Lyons

[11] Patent Number: 5,701,834

[45] Date of Patent: Dec. 30, 1997

[54] LIFT FOR WATERCRAFT

[76] Inventor: Richard A. Lyons, 5642 9th Ave. North, St. Petersburg, Fla. 33780

[21] Appl. No.: 703,344

[22] Filed: Aug. 26, 1996

[51] Int. Cl.[6] ..... B63C 1/02

[52] U.S. Cl. ..... 114/48; 405/3

[58] Field of Search ..... 114/44, 48, 51; 405/3

[56] References Cited

U.S. PATENT DOCUMENTS 4,432,664 2/1984 Baldyga ..... 405/3
4,482,268 11/1984 Stevenson et al. ..... 405/3
4,678,366 7/1987 Williamson ..... 405/3
4,983,067 1/1991 Montgomery ..... 114/44
5,245,940 9/1993 Rockwood ..... 114/48

*Primary Examiner*—Jesus D. Sotelo
*Attorney, Agent, or Firm*—Stein, Pendorf & Van Der Wall

[57] ABSTRACT

A boat lift having as its major components, a vertical rigid support column, a boat cradle and a carriage assembly interconnecting the boat cradle to the column support allowing the boat cradle to travel up and down the length of the support column to lift and lower the boat, by means of a winch assembly, out of and into a body of water and then rotate, once lifted, to a position above the boat dock to which the boat lift is connected.

12 Claims, 6 Drawing Sheets

LIFT FOR WATERCRAFT

BACKGROUND OF THE INVENTION

1. Field of the Invention

This invention relates to boat lifts. More particularly, this invention relates to boat lifts for lifting a personal watercraft to and from the water to a position level with the boat dock whereupon the cradle of the boat lift may then be pivoted to a position above the dock allowing easy access to the personal watercraft.

2. Description of the Background Art

Presently, there exists many types of boat lifts designed to lift a boat to and from a body of water to or on top of sea walls, docks, and other structures. Representative patents disclosing various types of boat lifts include U.S. Pat. Nos. 2,708,346; 2,888,152; 3,565,271; 4,432,664; 4,482,268; 4,678,366; 4,714,375; 4,832,210; 4,381,723; 4,983,067; and 5,090,842, the disclosures of which are hereby incorporated by reference herein.

More particularly, as best shown in U.S. Pat. Nos. 2,888,152; 4,432,664; 4,678,366; 4,983,067 and 5,090,842, one type of boat lift comprises a vertical rigid support column which is fixedly secured to the dock or sea wall. The boat cradle is operatively connected to the support column by means of a carriage assembly that is designed to travel up and down the support column. A drive mechanism, such as a winch or hydraulic cylinder/piston assembly, is operatively connected to the carriage assembly to cause the carriage assembly to travel along the vertical length of the support column so as to lift or lower the boat on the cradle out of or into the water.

Various types of carriage assemblies may be employed. For example, as shown in U.S. Pat. Nos. 2,888,152, 4,432,664, 4,983,067; and 5,090,842, the carriage assembly may include a tube-in-tube construction with the cradle being connected to the outer tube so that it may move up and down the inner tube. Alternatively, as shown in U.S. Pat. No. 4,678,366, the carriage assembly may comprise an I-beam construction with a surrounding collar having inwardly facing wheels that roll up and down the flat surface of the I-beam. Furthermore, some carriage assemblies of boat lifts are designed to be rotatable to allow rotation of the cradle, once lifted, to a position above the dock to allow easy access to the boat on the cradle. See for example, U.S. Pat. Nos. 2,888,152; 4,983,067 and 5,090,842. As shown in such patents, bearings are provided between the inner and outer tubes so as to enhance vertical and rotational movement of the out tube around the inner tube.

Unfortunately, the tube-in-tube construction as shown in U.S. Pat. Nos. 2,888,152; 4,983,067; and 5,090,842,with their associated bearings, are not well-suited to be used in saltwater environments. More particularly, as can be fully appreciated, barnacle growth will quickly occur on the inner tube from the point of high tide downward, with heaviest growth occurring from the point of mean low tide downward. The more barnacles grow on the inner tube, the more they will interfere with the bearings that allow the outer tube to slide up and down the length thereof and rotate therearound.

Therefore, it is an object of this invention to provide an improvement which overcomes the aforementioned inadequacies of the prior art devices and provides an improvement which is a significant contribution to the advancement of the boat lift art.

Another object of this invention is to provide a boat lift comprising a cradle which is operatively connected to a vertical rigid support column by means of a carriage assembly that remains operable even with significant barnacle growth.

Another object of this invention is to provide a boat lift having a cradle operatively connected to a vertical rigid support column via carriage assembly that allows the cradle to be rotated relative to the column so that the cradle can be positioned, once lifted, to a position above or on the dock.

Another object of this invention is to provide a boat lift which is simpler in construction than prior art boat lifts and that eliminates the need for bearings that may rendered inoperative due to barnacle growth.

Another object of this invention is to provide a boat lift for installation along a boat dock, sea wall or other permanent structure for vertical lifting a watercraft or other object from a body of water, comprising in combination: a non-round support column positioned vertically adjacent to the structure, the non-round support column including a fixed lower section and a rotatable upper section; a carriage assembly positioned about the non-round support column, the carriage assembly including a plurality of inwardly extending wheels for rolling up and down faces of the non-round support column; and a cradle affixed to the carriage assembly, whereby, the boat or other object may be lifted vertically out of the body of water by the cradle as the carriage assembly travels upwardly along the non-round support column and, when the carriage assembly is positioned on the rotatable upper section, the carriage assembly may be rotated to position the cradle and the object seated thereon above the structure.

Another object of this invention is to provide a method for lifting a watercraft or other object from a body of water to a boat dock, sea wall or other permanent structure, comprising the steps of: vertically positioning a non-round support column adjacent to the structure, the non-round support column including a fixed lower section and a rotatable upper section; positioning a carriage assembly about the non-round support column, the carriage assembly including a plurality of inwardly extending wheels for rolling up and down faces of the non-round support column; affixing a cradle to the carriage assembly; and seating the boat or other object onto the cradle and rolling the carriage assembly vertically upward along the length of the non-round support column and, when the carriage assembly is positioned on the rotatable upper section, rotating the carriage assembly to position the cradle and the object seated thereon above the structure.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the detailed description of the preferred embodiment in addition to the scope of the invention defined by the claims taken in conjunction with the accompanying drawings.

SUMMARY OF THE INVENTION

For the purpose of summarizing this invention, this invention comprises a boat lift having as its major components, a vertical rigid support column, a boat cradle and a carriage assembly interconnecting the boat cradle to the column support allowing the boat cradle to travel up and down the length of the support column to lift and lower the boat, by means of a winch assembly, out of and into a body of water and then rotate, once lifted, to a position above the boat dock to which the boat lift is connected.

More particularly, the column support comprises a non-round construction, such as a square pipe, having coaxial upper and lower sections that are allowed to rotate at a joint by means of an internal cylindrical pipe positioned inside of the upper and lower square pipes. The carriage assembly of the invention comprises a rectangular frame to which is journalled two sets of two wheels, one set at the upper rear and another set at the lower front portions of the frame assembly. The frame assembly is dimensioned so that the two sets of two wheels roll up and down the four faces of the square pipe as the carriage assembly is raised or lowered by the winch mechanism. Importantly, it is noted that when the carriage assembly is lifted upwardly to a point onto the upper section of the square pipe clear of the lower section of the square pipe, the carriage assembly and boat cradle may be rotated axially to a position above the dock.

An important feature of the boat lift of the invention is the employment of two sets of two wheels of the carriage assembly that roll up and down four faces of both sections of the square pipe of the support column. More particularly, such wheels that roll along the respective faces of the square pipe are largely unaffected by barnacle growth since, even with significant barnacle growth, the wheels tend to crush the barnacle growth as they roll along the respective faces of the square pipe. The disadvantages associated with prior art tube-in-tube constructions that employ bearings, are therefore eliminated.

Another important advantage to utilizing a square-pipe support column and the carriage assembly with the two sets of two wheels, is self-alignment. More particularly, since the two sets of four wheels of the carriage assembly roll up and down the four faces of the square pipe of the support column, the carriage assembly is maintained in a precise rotational position relative to the square pipe inasmuch as the two sets of two wheels cannot rotate around the circumference of the square pipe. Consequently, the boat cradle is always maintained at a precise angular position relative to the square pipe. Therefore, when the carriage assembly is located on the lower section of the square pipe, the cradle is always properly oriented away from the dock and is not allowed to rotate relative to the axis of the support column. When the carriage assembly is positioned on the upper section of the square pipe, the upper section of the square pipe may be axially rotated relative to the lower section, thereby positioning the cradle to a position above the dock.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
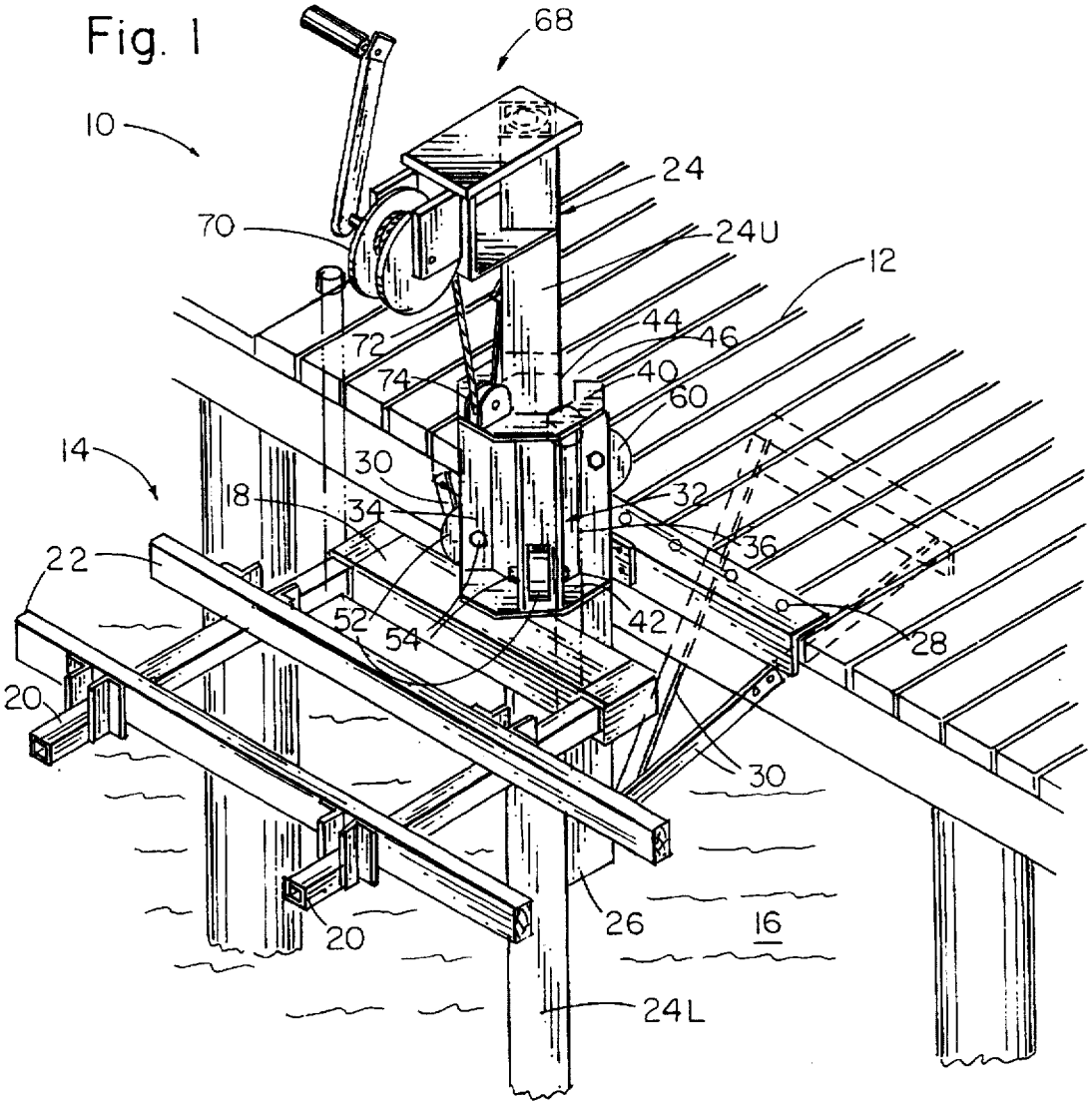
FIG. 1 is a top perspective view of the boat lift of the invention illustrating the carriage assembly thereof positioned on the upper section of the square-tube vertical rigid support column thereof.

As best seen in FIG. 1, the boat lift 10 of the invention is designed to be installed adjacent to a floating or fixed dock 12, sea wall, or other structure. The boat lift 10 functions to raise and lower a boat cradle 14 out of and into a body of water 16 and, when positioned above the level of the dock 12, to then rotate the boat cradle 14 onto the dock 12 (see FIGS. 7A & 7B). The boat cradle 14 includes an elongated base 18 with a pair of outwardly extending arms 20. A pair of bunks 22 are rigidly secured transverse to the arms 20 (parallel to the elongated base 18) for supporting a boat (not shown), such as a personal watercraft. Without departing from the spirit and scope of this invention, the boat cradle 14 may comprise any desired type or configuration that is optimal for the type of boat that the boat lift 10 is intended to lift in and out of the water 16. The boat lift 10 further comprises a vertical rigid support column 24 that is non-round in cross-section, such as a square pipe.

Figure 6:
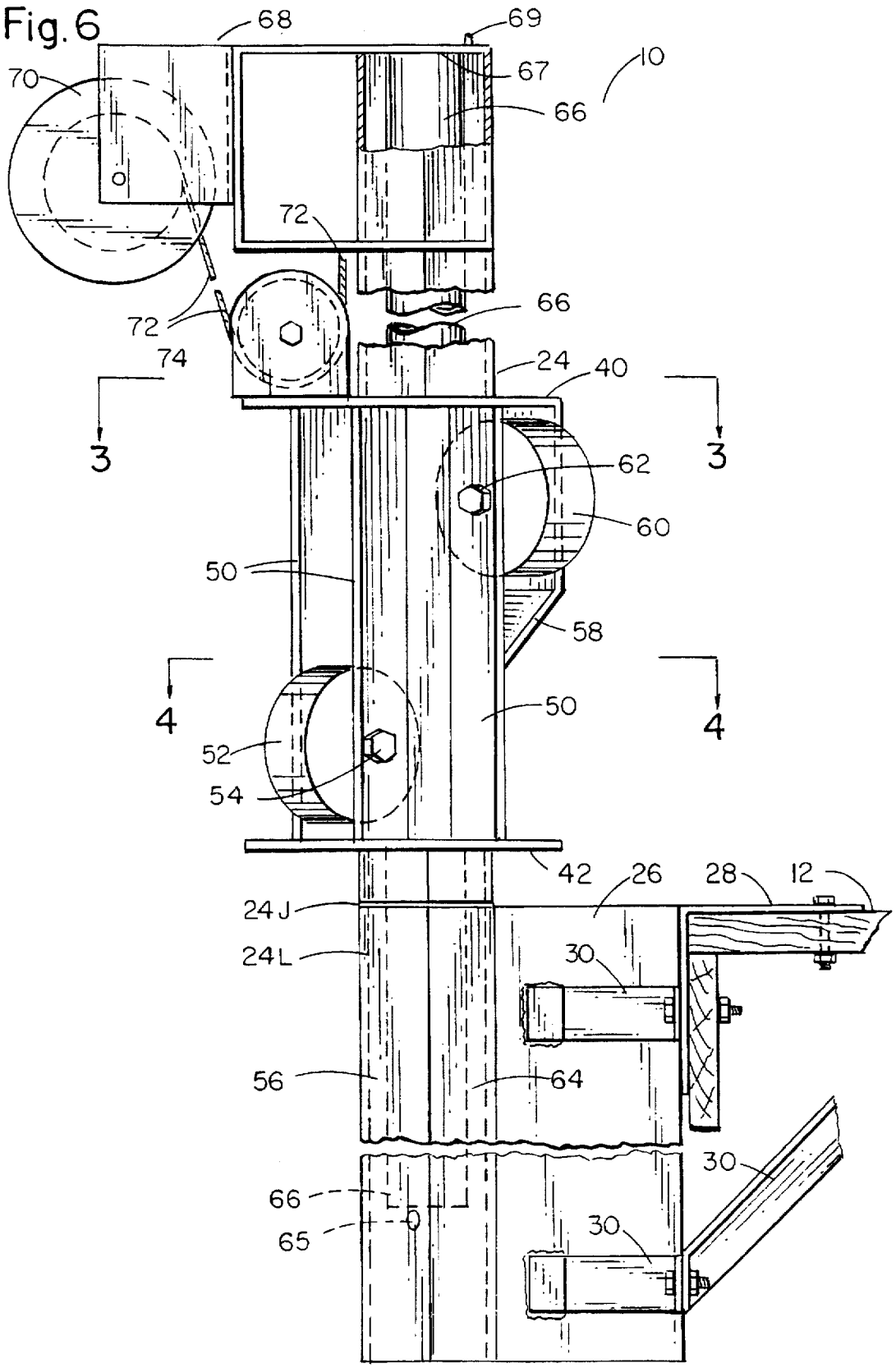
FIG. 6 is a side view, partially in cross-section, illustrating the cylindrical pipe fitted into the upper and lower sections of the square pipe allowing rotation of the upper section.

As shown in FIGS. 1, 6 & 7, the square-pipe support column 24 is rigidly connected to the dock 12 by means of a longitudinal stand-off 26. The front longitudinal edge of the stand-off 26 is welded to a corner edge of a length of the square tube support column 24. The upper portion of the rear edge of the stand-off 26 is rigidly connected to a horizontal plate 28 bolted to the horizontal edge of the dock 12. The lower portion of the rear edge of the stand-off 26 is rigidly connected to the underside of the dock 12 by means of four upwardly extending braces 30.

Figure 3:
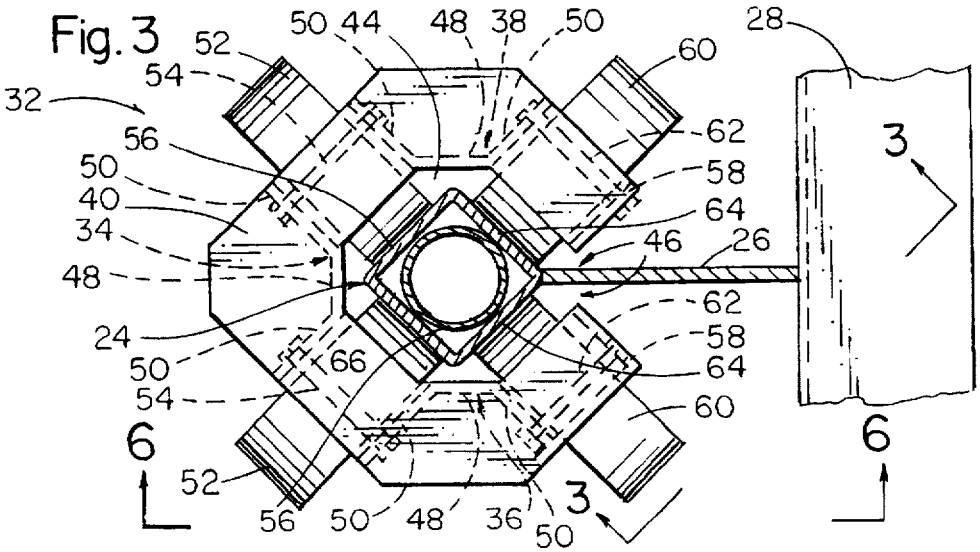
FIG. 3 is a cross-sectional view of FIG. 6 along lines 3—3 illustrating the configuration of the top plate of the carriage assembly and the manner that it straddles the stand-off when the carriage assembly is positioned on the lower section of the square-pipe support column.
Figure 2B:
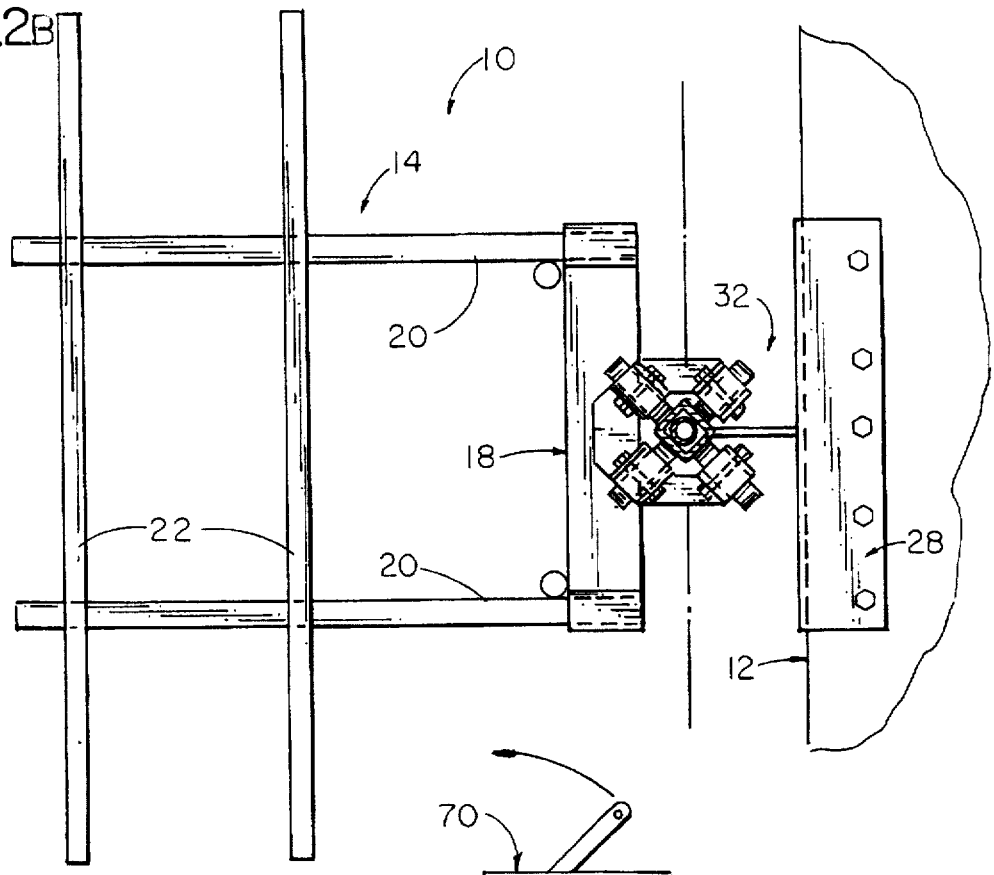
FIG. 2B is a cross-sectional view of FIG. 2A along lines 2B—2B showing the positioning of the wheels of the carriage assembly on the faces of the square-tube vertical rigid support column.
Figure 2A:
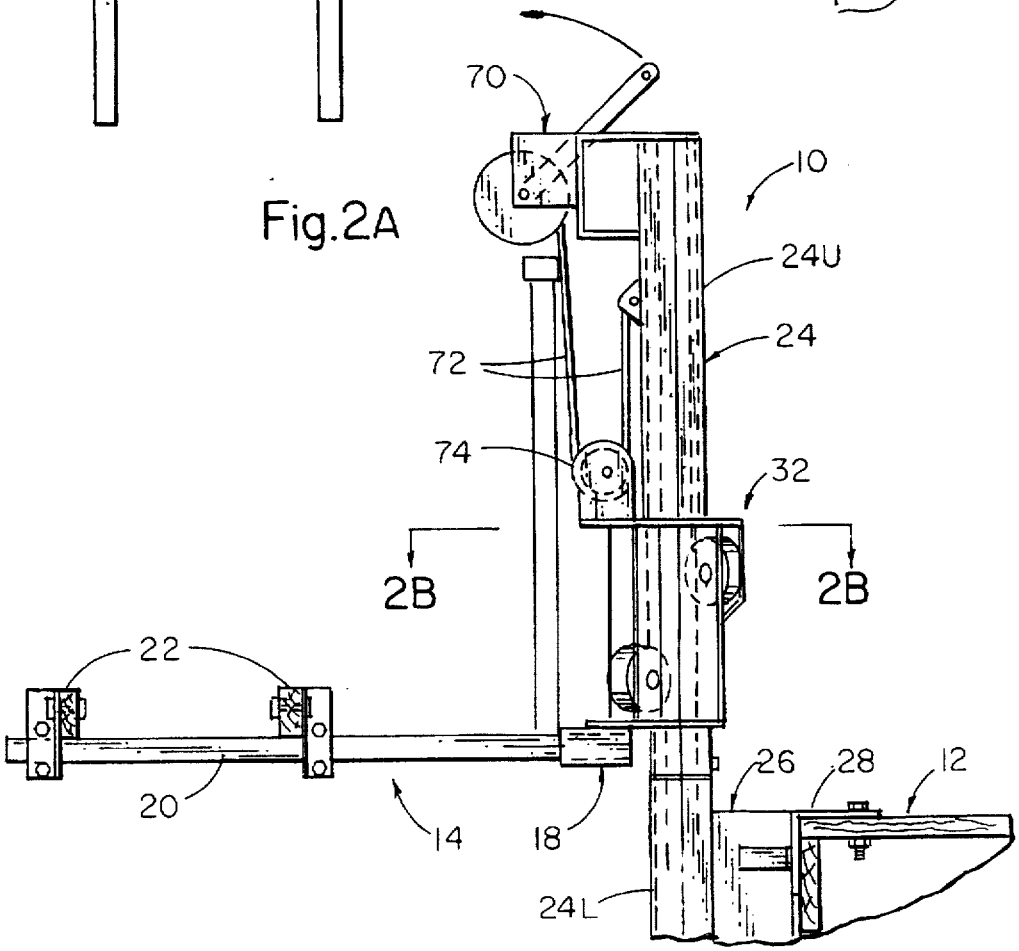
FIG. 2A is a side view of the carriage assembly of FIG. 1 positioned on the upper section of the square-tube vertical rigid support column above the joint between the upper and lower sections thereof.
Figure 4:
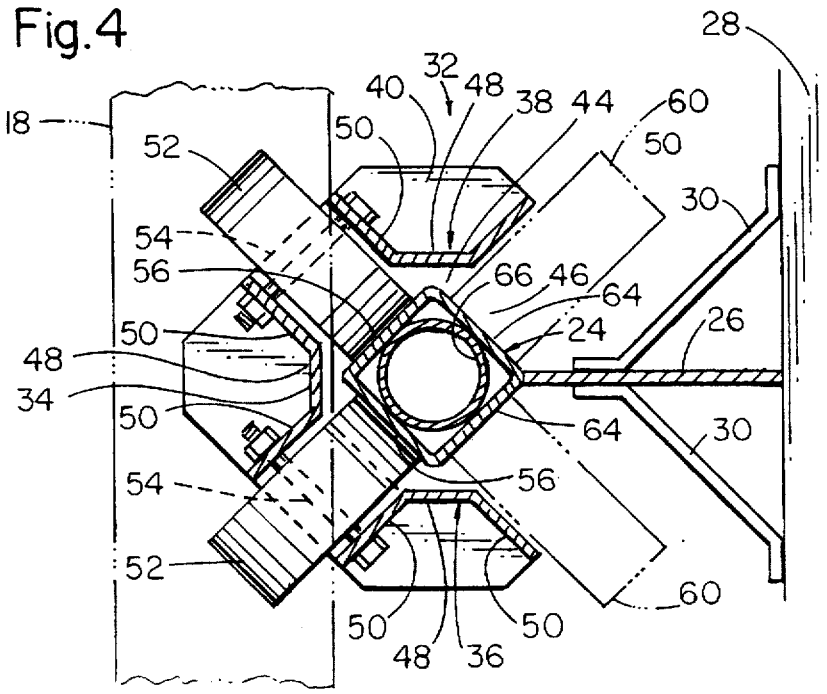
FIG. 4 is a cross-sectional view of FIG. 6 along lines 4—4 illustrating the cross-sectional configuration of the vertical plates of the carriage assembly that interconnects the top and bottom plates thereof.

As shown in the various figures of the drawings, the boat lift 10 of the invention further includes a carriage assembly 32 designed to travel up and down the length of the square-pipe support column 24. As best seen in FIG. 4, carriage assembly 32 comprises three vertical plates: a front plate 34 and left and right rear side plates 36 and 38. The plates 34–38 are rigidly connected between horizontal top and bottom plates 40 and 42 (see FIG. 3 & 6). The top and bottom plates 40 and 42 each include a center hole 44 (substantially square-shaped) through which the support column 24 is positioned. The top and bottom plates 40 and 42 also include an opening 46 positioned at the rearmost corner of the square center hole 44 so as to allow room for the stand-off 26. The base 18 of the cradle 14 is rigidly secured to the bottom plate 42 so that the cradle 14 moves with the carriage assembly 32 at all times (see FIGS. 1 and 2A).

Each of the plates 34–38 include an elongated flat middle portion 48 and elongated flat end portions 50. The end portions 50 are positioned at approximately 45E relative to the middle portion 48 so that the end portions 50 of adjacent plates 34–38 are positioned in a parallel, spaced-apart manner for receiving a pair of lower front wheels 52 having axles 54 journalled to such end portions 50. The lower front wheels 52 roll up and down the front faces 66 of the square-pipe support column 24 as the carriage assembly 32 is raised or lowered along the length thereof (see FIGS. 1, 2, 3 & 4).

Figure 5:
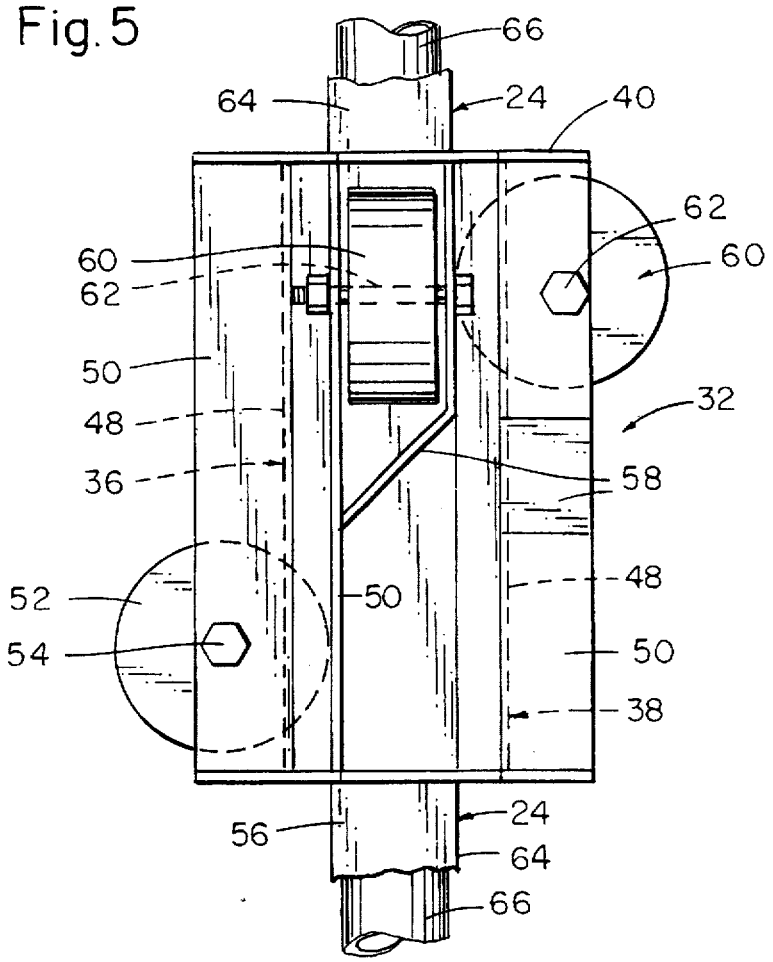
FIG. 5 is a rear view, taken at an angle perpendicular to the axis of one of the upper rear wheels, showing the wheel bracket in the upper portion of one of the rearward vertical plates between which the upper rear wheel is journalled.

As best shown in FIG. 5, wheel brackets 58 are welded to the upper rearward-facing sides of the end portions 50 of the left and right rear side plates 36 and 38. Upper rear wheels 60 are positioned within the wheel brackets 58, respectively, and their axles 62 are respectively journalled between the end portions 50 and the brackets 58. The upper rear wheels 60 roll along the rear faces of the square-pipe support column 24 along the length thereof.

It is noted that the rear wheels 60 are positioned in the upper portion of the carriage assembly 32 and the front wheels 52 are positioned at the lower portion thereof since the cradle 14 extends outwardly from the front of the carriage assembly 34 creating a cantilever effect. Importantly, since the wheels 52 and 60 roll along their respective faces 56 and 64, the carriage assembly 32 is kept from rotating relative to the square-pipe support column 24. However, it should be appreciated that any number of wheels may be employed without departing from the spirit and scope of this invention so long as they roll up and down along the flat faces of a non-round support column 24 thereby preventing relative rotational movement. For example, a triangular-shaped support column with three faces may be employed in which case at least three wheels would also be employed. Finally, it is noted that the faces of the non-round support column are described as being "flat"; however, it should be appreciated that they may include certain amount of curvature so long as the wheels are prevented from rotating around the circumference as would otherwise occur with a round support column.

The square-pipe support column 24 includes an upper section 24U and a lower section 24L with joint 24J. Joint 24J is preferably positioned at or above the level of the dock 12. A member such as a cylindrical pipe 66 is positioned within the upper and lower sections of the support column 24 at the joint 24J so as to maintain the axial alignment of the upper and lower sections while allowing the upper section 24U to rotate relative to the lower section 24L. It is noted that in order to secure the cylindrical pipe 66 in position relative to joint 24J, the cylindrical pipe 66 is seated upon an inwardly formed dimple 65 in the lower section such that the cylindrical pipe 66 is seated thereon. Preferably the upper end of the cylindrical pipe 66 bears against an end plate 67 welded to the upper end of the upper section of the square-pipe support column 24. With this arrangement, the end plate 67 supports the weight of the upper section and provides a bearing surface with the uppermost end of the cylindrical pipe 66. A grease fitting 69 may be provided for allowing lubrication of the bearing surfaces. Easy rotational movement of the support column's upper section relative to its lower section is therefore assured.

Figure 7A:
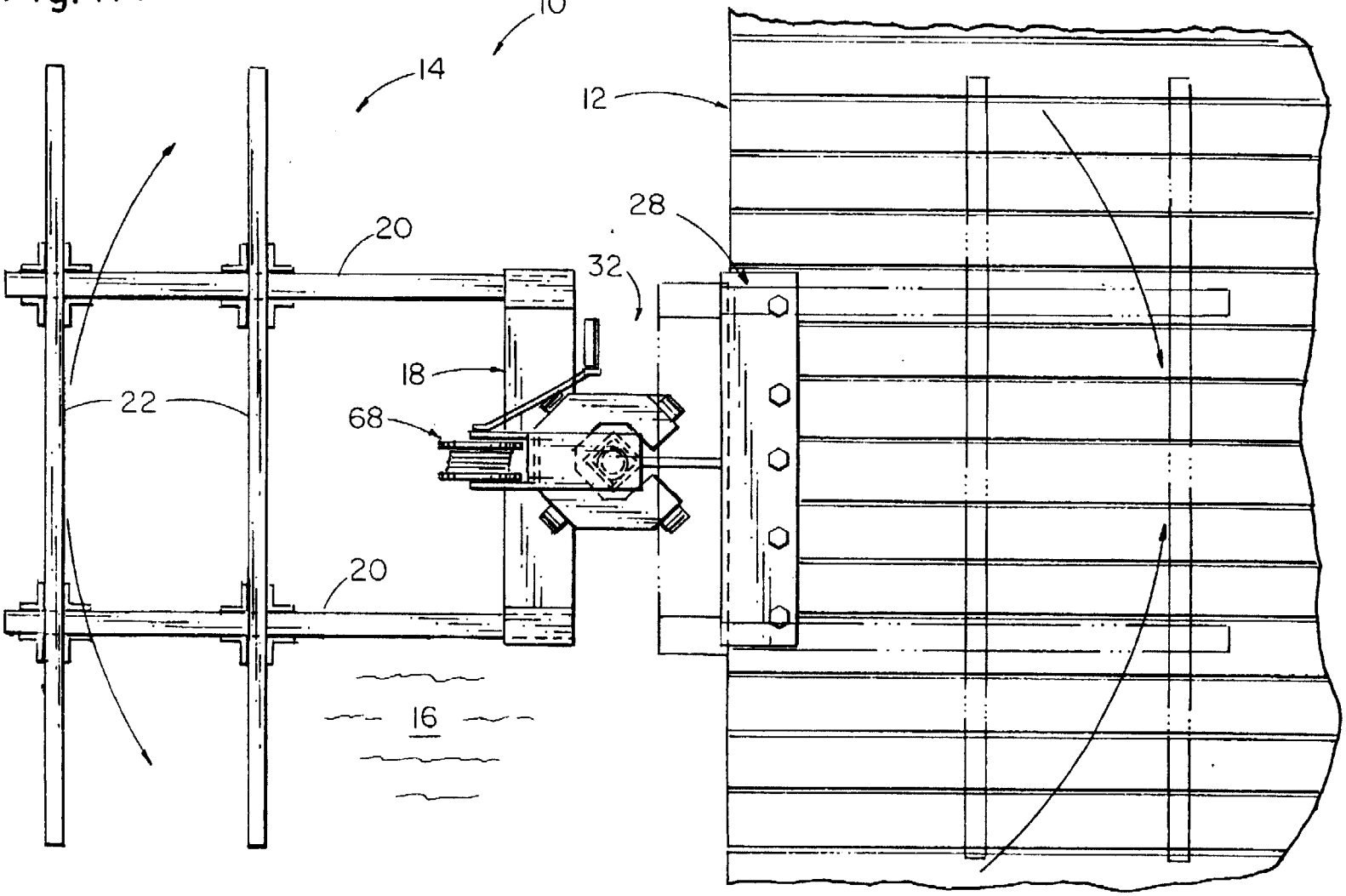
FIG. 7A is a top plan view of the boat lift of the invention showing the carriage assembly positioned extending away from the boat dock and showing, in phantom, the rotational movement of the carriage assembly 180 degrees to a position above the boat dock.
Figure 7B:
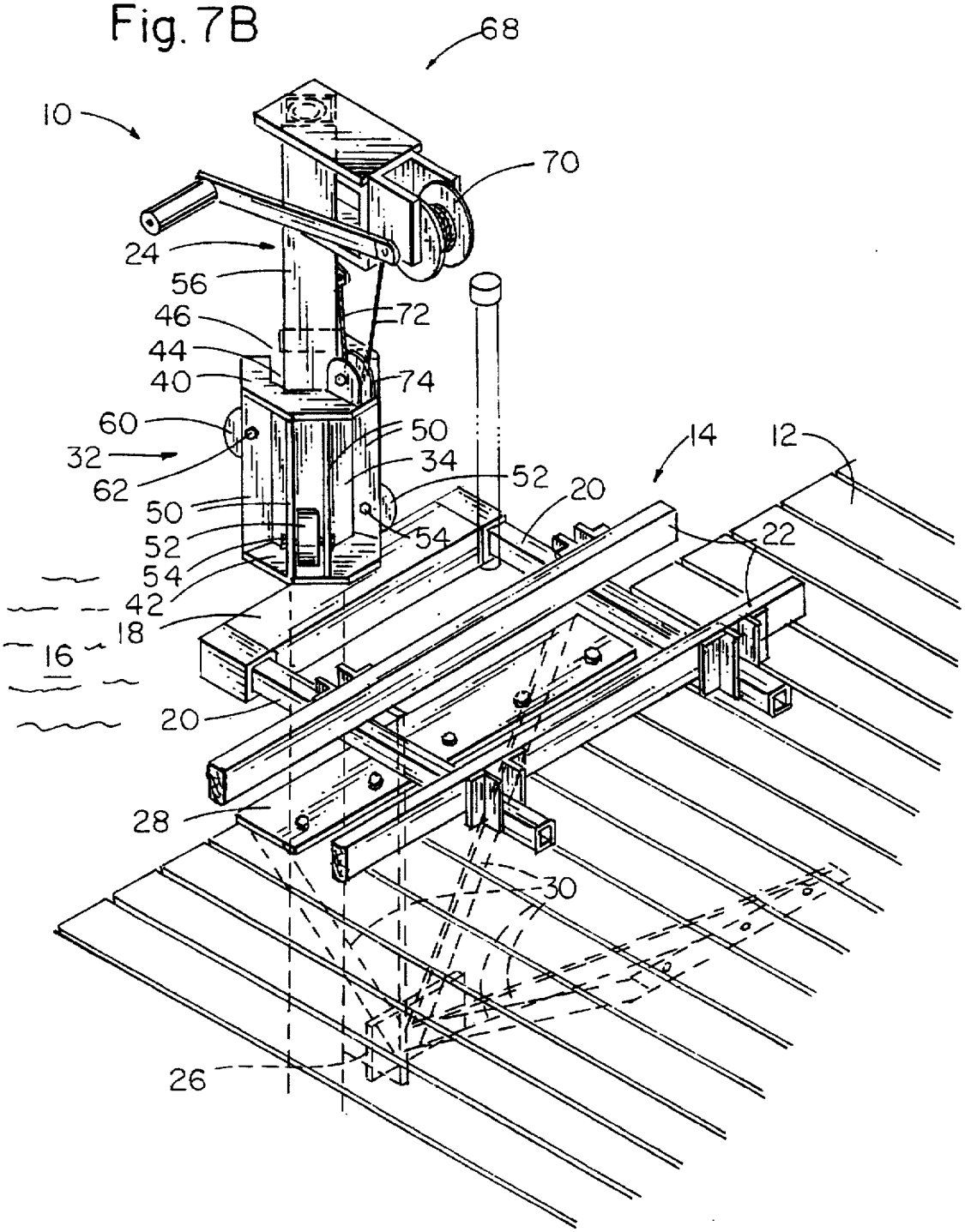
FIG. 7B is a perspective view showing the cradle in the 180 degree rotated position above the dock.

As shown in FIGS. 7A & 7B, the upper and lower sections of the support column 24 interconnected by the cylindrical pipe 66 at joint 24J allows the carriage assembly 14, when positioned on the upper section 24U of the support column 24, and cradle 14 to be rotated 180 degrees to a position above the dock 12.

Returning to FIG. 1, movement of the carriage assembly 32 along the vertical length of the support column 24 is accomplished by means of a suitable winch assembly 68 that is preferably rigidly secured to the upper portion of the upper section 24U of the support column 24. Winch assembly 68 includes a conventional winch 70 with cable 72 that extends through a corresponding pulley 74 rigidly secured to the top plate 40 of the carriage assembly 32 back to the winch assembly 68. As should be appreciated, extension of the cable 72 from the winch 70 allows the carriage assembly 32 to move downwardly along the length of the support column 24 due to gravity and, conversely, operation of the winch 70 to retract cable 72 causes the carriage assembly 32 to be moved upwardly along the support column 24. Without departing from the spirit and scope of this invention, any type of winch may be employed.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A lift for installation along a boat dock, sea wall or other permanent structure for vertically lifting a watercraft or other object from a body of water, comprising in combination:

a non-round support column positioned vertically adjacent to the structure, said non-round support column including a fixed lower section and a rotatable upper section, said non-round support column being substantially square in cross-section with four faces and wherein said carriage assembly includes at least four inwardly extending wheels for rolling for rolling up and down said four faces of said non-round support column;

a carriage assembly positioned about said non-round support column, said carriage assembly including a plurality of inwardly extending wheels for rolling up and down faces of said non-round support column, said carriage assembly includes a plurality of vertical plates extending between upper and lower horizontal plates, said horizontal plates including a center hole through which passes said non-round support column, said wheels being journalled relative to said vertical plates to extend inwardly in rolling engagement with said non-round support column; and a cradle affixed to said carriage assembly, whereby, the boat or other object may be lifted vertically out of the body of water by said cradle as the carriage assembly travels upwardly along the non-round support column and, when said carriage assembly is positioned on said rotatable upper section, said carriage assembly may be rotated to position said cradle and the object seated thereon above the structure.

2. The lift as set forth in claim 1, wherein two of said wheels of said carriage assembly are positioned forwardly of said non-round support column at a lower portion of said carriage assembly and the other two of said wheels of said carriage assembly are positioned rearwardly of said non-round support column at an upper portion of said carriage assembly.

3. The lift as set forth in claim 1, wherein at least two adjacent said vertical plates each include an elongated middle portion and an elongated end portion, said elongated end portions being positioned substantially parallel to each other with one of said wheels being journalled therebetween.

4. The lift as set forth in claim 1, wherein at feast one of said vertical plates includes a wheel bracket to which is journalled one of said wheels.

5. The lift as set forth in claim 1, further including at least one brace secured relative to said non-round support column wherein said non-round support column may be secured adjacent to the structure by said brace.

6. The lift as set forth in claim 1, further including a stand-off and a brace secured relative to said stand-off wherein said non-round support column may be secured vertically adjacent to the structure by said stand-off and said brace.

7. The lift as set forth in claim 1, further including a horizontal plate secured relative to said non-round support column wherein said non-round support column may be secured vertically adjacent to the structure by said horizontal plate.

8. The lift as set forth in claim 1, further including a winch assembly secured relative to said non-round support, said winch assembly including a winch cable secured relative to said carriage assembly for raising said carriage assembly along the length of said non-round support column.

9. The lift as set forth in claim 1, wherein said non-round support column includes a member positioned therein extending from said lower section to said upper section for allowing relative rotational movement between said upper and lower sections of said non-round support column.

10. The lift as set forth in claim 9, wherein said member positioned within said non-round support column is cylindrical.

11. The lift as set forth in claim 9, wherein said upper section of said non-round support column includes an end plate and wherein an uppermost end of said member bears against said end plate.

12. The lift as set forth in claim 9, wherein said lower section includes an inwardly extending dimple upon which said member is seated.

* * * * *